US006604911B2

(12) United States Patent
Pauwels

(10) Patent No.: US 6,604,911 B2
(45) Date of Patent: Aug. 12, 2003

(54) METHOD FOR REGULATING A FAN IN A COMPRESSOR UNIT AND COMPRESSOR UNIT WITH FAN REGULATED IN SUCH MANNER

(75) Inventor: David Henri Florent Pauwels, Brasschaat (BE)

(73) Assignee: Atlas Copco Airpower, naamloze vennootschap (BE)

( * ) Notice: Subject to any disclaimer, the term of this patent is extended or adjusted under 35 U.S.C. 154(b) by 0 days.

(21) Appl. No.: 09/858,537

(22) Filed: May 17, 2001

(65) Prior Publication Data

US 2002/0157404 A1 Oct. 31, 2002

(30) Foreign Application Priority Data

May 17, 2000 (BE) ..... 2000/0332

(51) Int. Cl.[7] ..... F04B 5/00; G05D 15/00

(52) U.S. Cl. ..... 417/53; 417/244; 417/313; 165/299

(58) Field of Search ..... 417/244, 313, 417/53; 418/85, DIG. 1; 123/563; 165/299, 300, 921

(56) References Cited

U.S. PATENT DOCUMENTS

| | | | | |
|---|---|---|---|---|
| 4,289,461 A | * | 9/1981 | van Oorschot et al. | 418/84 |
| 5,263,832 A | * | 11/1993 | Yamaguchi | 418/9 |
| 5,590,539 A | | 1/1997 | Marohl et al. | |
| 5,873,257 A | | 2/1999 | Peterson | |
| 5,910,161 A | | 6/1999 | Fujita et al. | |
| 6,027,311 A | * | 2/2000 | Hill et al. | 417/53 |
| 6,247,314 B1 | * | 6/2001 | Biehler | 60/657 |

FOREIGN PATENT DOCUMENTS

WO 00/1290 3/2000

* cited by examiner

*Primary Examiner*—Charles G. Freay
(74) *Attorney, Agent, or Firm*—Bacon & Thomas, PLLC

(57) ABSTRACT

A method for regulating a fan in a compressor unit which having at least one compressor element, a motor connected to the compressor element, and a cooler including at least one radiator and a fan cooperating therewith; driven by a motor. The motor of the compressor element is driven at a speed varying as a function of it's a load and the number of revolutions of the motor of the fan is regulated as a function of a selected lever of cooling, thereby mitigating condensation of moisture by excessive cooling. The unit includes a speed regulation device connected to the motor of the compressor element.

14 Claims, 4 Drawing Sheets

METHOD FOR REGULATING A FAN IN A COMPRESSOR UNIT AND COMPRESSOR UNIT WITH FAN REGULATED IN SUCH MANNER

BACKGROUND OF THE INVENTION

1. Field of the Invention

This invention relates to a method for regulating a fan in a compressor unit which comprises at least one compressor element, at least one motor with electronically adjustable speed driving this compressor element, and at least one cooler comprising at least one radiator and at least one fan cooperating therewith, driven by an electric motor, whereby the motor of the compressor element is driven at a speed varying in function of its load.

2. Discussion of the Related Art

In an air-cooled air compressor with oil lubrication, such cooler can be provided in the outlet of the compressor element, before or after the oil separator or the pressure vessel.

In this application, oil must be comprehended in a broad sense. By oil, not only mineral oil must be understood, but also any viscous agent which can be used for lubricating and cooling rotors, gear wheels or bearings and which is hydrophobic or incompatible with water.

In a multistage-compressor, the cooler can be mounted in between the stages.

In the known compressor units, the fan, during cooling, always is driven at a constant number of revolutions, to wit a number of revolutions whereby it still can cool sufficiently in the worst working circumstances of the compressor element, this is with the highest working pressure, at maximum load, and with the highest air humidity and air temperature.

In consideration of the fact that the load of the motor of the compressor element and, therefore, also its number of revolutions, varies, a constant speed of the fan at a low load results in too large a cooling.

In the first place, this is disadvantageous for the energy consumption. If the fan motor at its set number of revolutions consumes, for example, 5 kW of power, this will be only 0.2 kW with the minimum number of revolutions.

In the second place, this constant number of revolutions brings along that the cooling may be too large, which can result in a condensation of moisture originating from the suctioned and compressed air.

If the compressor is a compressor cooled by means of oil, then the condensed water in the oil is strongly disadvantageous for the working of the compressor element.

If the same oil also is used for lubricating the bearings, then the water in the oil is very bad for the service life of this latter.

In such oil-cooled compressor, the oil, after the compressor element, is separated in an oil separator and returned to the compressor element.

It is known to place the cooler into the return conduit for the oil and to place a thermostatic valve in this return conduit, which valve, when the temperature of the oil drops below a certain border value, redirects the oil to the compressor element via a bypass of the cooler.

The oil which is injected into the compressor element therefore does not cool off further, as a result of which the compressed air getting into the oil separator can be sufficiently warm, as no moisture should condensate there.

As the fan further revolves at full speed, whereas the oil is flowing through the bypass, this fan further cools down the radiator. When then the oil is sufficiently warm because the thermostatic valve again shall alter its position, warm oil gets into this radiator, which brings along large thermic shocks.

The further revolving fan also cools down other parts of the compressor, such that, even if the oil is not directed through the cooler, this can be cooled somewhat and the formation of condensation in the oil separator still is not excluded.

In multistage-compressor units, an intermediate cooler cooled by a fan driven at a constant number of revolutions at low load also may cool too much, which also may lead to the formation of condensation.

Even in the case of an oil-free multistage-compressor unit, water drops which, with the air at high speed, are carried along in the high-pressure stage, may cause damages there.

SUMMARY OF THE INVENTION

The invention aims at a method for controlling a fan in a compressor unit which remedies said disadvantages and, in the first place, allows to avoid condensation problems and further has a better energetic efficiency, reduces or prevents thermic tensions in the coolers and can reduce the noise level.

According to the invention, this aim is achieved in that the number of revolutions of the motor of the fan is regulated in function of the required cooling, however, such that condensation of moisture due to exaggerated cooling is avoided.

FURTHER PRIOR ART

U.S. Pat. No. 5,910,161 describes a method whereby the motor of fans of a compressor unit is regulated, however, the compressor unit forms part of a cooling device, and the fans cool the condensers in the cooling circuit, and this such that in these condensers, the cooling medium is condensed completely.

Also U.S. Pat. No. 5,873,257 relates to a cooling device whereby also the condenser is cooled by a fan of which the speed of the motor is regulated in this manner. Of course, in the condenser a condensation of the cooling medium is taking place. Also opposite to the evaporator, a fan with controlled motor is installed, however, this evaporator is no cooler.

FURTHER SUMMARY OF THE INVENTION

According to the invention, preferably the speed of the motor of the fan is regulated in function of the speed of the motor of the compressor element.

The speed of the motor of the fan can be regulated in function of the speed of the motor driving the compressor element, such that the ratio of the speeds of both motors takes a course according to an empirically determined curve.

The invention also relates to a compressor installation with a fan which is regulated according to the method according to the invention, described in the aforegoing.

Thus, the invention relates to a compressor unit comprising at least one compressor element, at least one motor with electronically adjustable speed which drives this compressor element at a speed varying in function of its load, and at least one cooler which comprises at least one radiator and at least one fan cooperating therewith, driven by an electric motor, whereby the characterizing feature consists in that the motor of the fan is a motor with electronically adjustable speed and is coupled to means for regulating its speed in function of the required cooling, such that its speed varies in function of the required cooling, whereas condensation of moisture due to exaggerated cooling is avoided.

The speed regulating device or otherwise means for regulating the speed of the motor of the fan preferably are coupled to the seed regulating device or otherwise means for regulating the speed of the motor driving a compressor element.

Thereby, the means for regulating the speed of the motor of the fan can be coupled such to the means for regulating the speed of the motor driving a compressor element that the ratio of the speeds of both motors takes a course according to an empirically determined curve.

In a practical embodiment, the compressor unit comprises an oil-cooled compressor element to which a pressure conduit connects in which an oil separator is mounted, whereby this oil separator is connected to the compressor element by means of a return conduit for oil in which the radiator of an oil cooler with a fan is mounted and this fan is the fan which is coupled to said means for regulating its speed.

In another embodiment, the compressor unit comprises several stages and thus at least a low-pressure compressor element and a high-pressure compressor element and, in the intermediate conduit connecting the two compressor elements to each other, the radiator of an intermediate cooler with a fan is mounted and is this fan the fan which is coupled to said means for regulating its speed.

BRIEF DESCRIPTION OF THE DRAWINGS

With the intention of better showing the characteristics of the invention, hereafter, as an example without any limitative character, several preferred forms of embodiments of a method for regulating a fan in a compressor unit and of a compressor unit provided with a fan regulated in this manner, according to the invention are described, with reference to the accompanying drawings, wherein.

DESCRIPTION OF PREFERRED EMBODIMENTS

Figure 1:
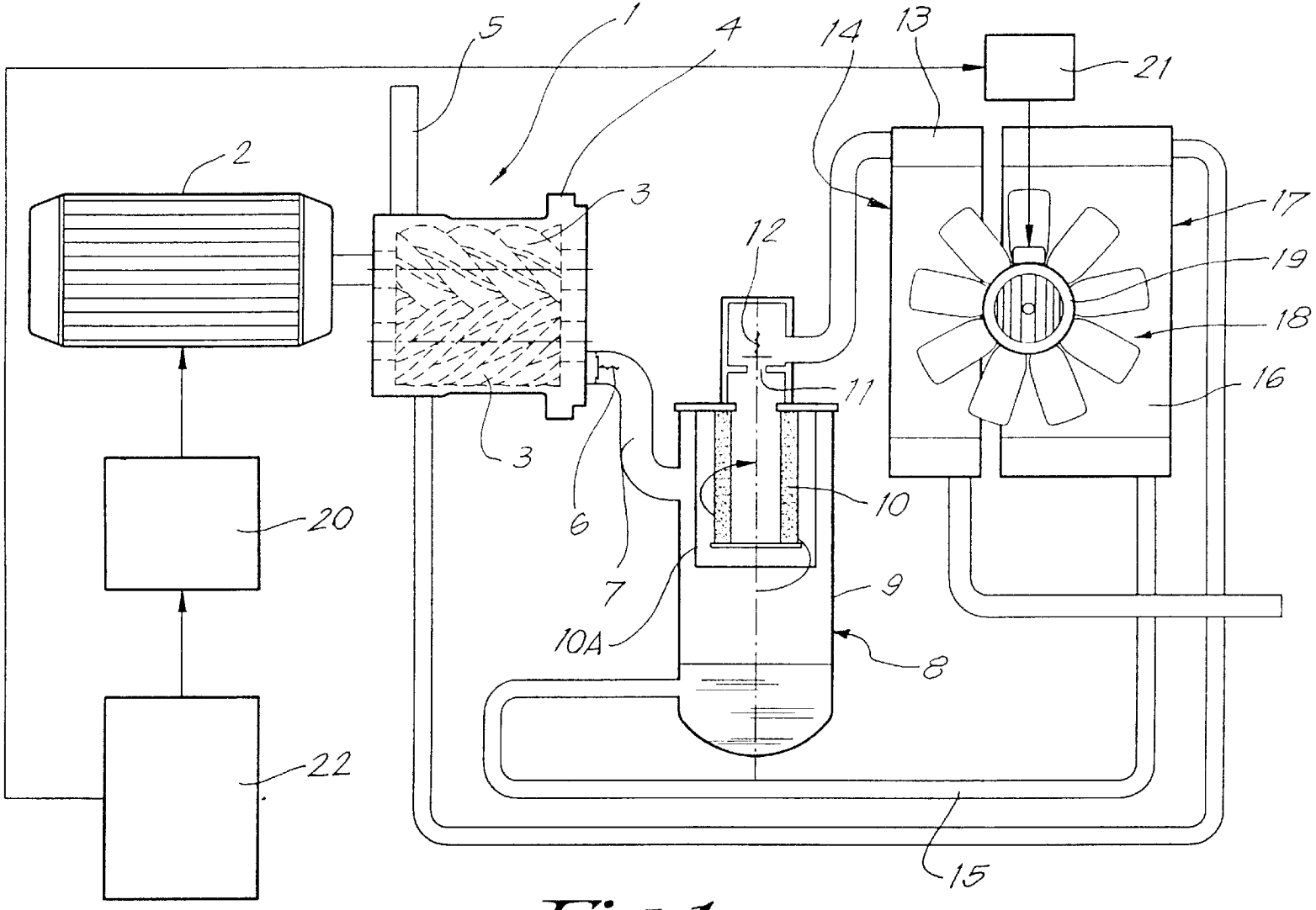
FIG. 1 schematically represents a compressor unit according to the invention.

The compressor unit for compressing air from the environment, represented in FIG. 1, comprises an oil-cooled compressor element 1 driven by means of an electric motor 2 with electronically adjustable speed.

In the represented example, the compressor element 1 is a screw-type compressor element with two screw-shaped rotors 3 which are beared in a housing 4.

The interior space of the housing 4 or rotor chamber connects to an air-suctioning conduit 5, whereas, by means of a return valve 6, gives out into a pressure conduit 7 for the compressed air.

In this pressure conduit 7, an oil separator 8 is provided which also forms a pressure vessel.

This oil separator 8 consists of a vessel 9 in which at the top, a filter 10 is mounted which is surrounded by a screen 10A.

The pressure conduit 7 gives out in the vessel 9, opposite to the screen 10A, and a part of the oil in the compressed air is mechanically separated by this screen 10A and flows downward along this screen 10A.

The remainder of the oil is kept back by the filter 10 which is situated opposite to the exit 11 of the vessel 9. This exit 11 can be closed off by a return valve 12.

Further, the radiator 13 of an air cooler 14 is mounted in the pressure conduit 7.

To the underside of the vessel 9, a return conduit 15 for the collected oil connects, which, by means of a spray head, connects to the interior side of the housing 4.

In this return conduit 15, the radiator 16 of an oil cooler 17 is mounted.

The air cooler 14 and the oil cooler 17 have a common fan 18 which is driven by an electric motor 19 with electronically adjustable speed and which, thus, is mounted opposite to the two radiators 13 and 16.

The number of revolutions of the motor 19 of the fan 18 is variable in function of the number of revolutions of the motor 2 which drives the oil-injected compressor element 1.

Both motors 2 and 19, for example, are induction motors, the speed of which depends on the frequency of the power supply, and are controlled by the intermediary of a frequency transformer 20, 21, respectively, by means of the same control system 22, in the manner described in the following.

The frequency transformer 20, together with the control system 22, forms a speed regulation device or otherwise means for regulating the speed of the compressor element 1 in function of the load, such in order to be able to deliver the required flow rate at a constant pressure, to wit the working pressure normally set by the user.

The means for regulating the speed of the fan 18 and thus for regulating the cooling capacity or thus the cooling of the oil flowing through the radiator 16, consist of the frequency transformer 21 which, as will be explained in the following, in its turn is controlled by the frequency transformer 20, directly or by means of the control system 22.

In order to avoid the condensation of moisture from the suctioned air in the oil separator 8, the temperature in the oil separator 8 always must remain above the condensation temperature, in order to avoid that water can be formed which exerts a disadvantageous influence on the working of the compressor element.

The condensation temperature in the oil separator 8 depends on the conditions of the environment, in particular the moisture content of the air suctioned by means of suction conduit 5, and the pressure prevailing in the oil separator 8.

With the exception of the pressure drops in the oil separator 8, in particular in the filter 10 thereof, in the air cooler 14 and in the air outlet system, this pressure corresponds to the working pressure of the compressor. These pressure drops are relatively small and therefore will be disregarded in the following.

The required minimum temperature in the oil separator 8 and, thus, also the outlet temperature of the compressor element 1 in order to avoid condensation, is equal to the saturation temperature or condensation temperature Tv in 10 the oil separator 8 and can be calculated by means of the following equation:

$$\frac{Ps(Tv)}{Pk - Ps(Tv)} = \frac{Hr \cdot Ps(Ta)}{Po - Hr \cdot Ps(Ta)} \quad (A)$$

wherein:

Pk=the pressure in the oil separator 8=the working pressure;

Po=the pressure of the suctioned air (the barometer pressure);

Hr=the relative humidity of the suctioned air;

Ta=the environmental temperature;

Ps(Tv)=the vapour tension of steam at temperature T.

For given inlet conditions Po, Ta and Hr, from equation (A) the saturation temperature Tv can be calculated for a certain working pressure.

The compressor unit is placed into a testing cell, such that the humidity and the temperature of the air suctioned by the compressor element 1 can be adjusted.

For the worst case, this is with the highest occurring moisture content in the environment, by means of said equation (A), the required minimum temperature or the saturation temperature Tv with varying environmental temperatures Ta for the air is calculated, and such for different chosen working pressures.

Figure 2:
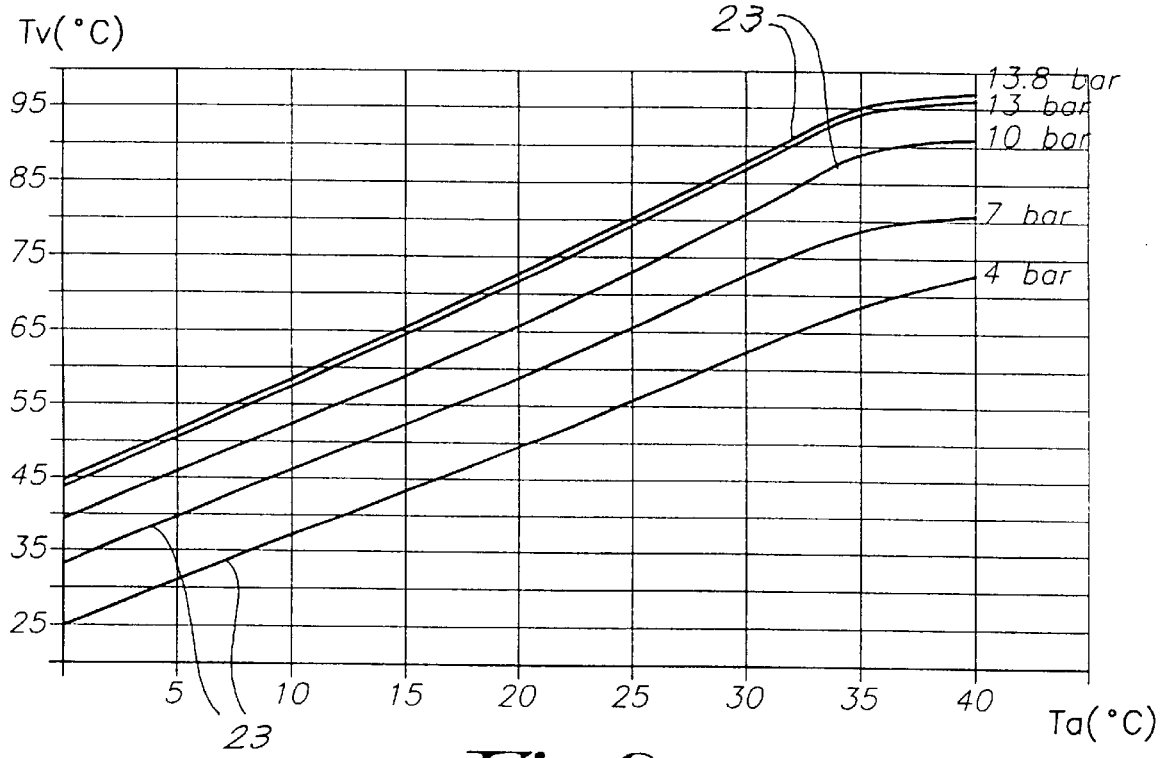
FIG. 2 represents a graphic chart of the temperature in the oil separator, whereby just no condensation occurs, in function of the environmental temperature.

In FIG. 2, a graphic chart is represented in which the result of these calculations is represented. For each working pressure, a curve 23 is obtained which is almost straight.

The outlet temperature Tu of the compressor element 1, which thus is equal to the real temperature Tx in the oil separator 8, is a linear function of the number of revolutions N of the compressor element 1.

$$Tu=Tx=Toi+A+B.N \quad (B)$$

Herein, Toi is the oil injection temperature in the compressor element 1, which usually is equal to the temperature after the oil cooler 17, and A and B are constants depending on the compressor element 1.

Thus, in order to keep the temperature Tx for a certain working condition constant and above the saturation temperature Tv with a variable number of revolution N, the oil injection temperature Toi must be varied. By regulating the speed of the motor 19 of the fan 18, the cooling air flow rate through the oil cooler 17 and, therefore, also the cooling capacity and parallel thereto, the oil outlet temperature from the oil cooler 17 and, thus, also the oil injection temperature Toi varies.

From the general equation for an air-oil heat exchanger or cooler equation, it is obvious that:

$$\text{Changed power}=Kf.A.\Delta t_{1n}=\text{mass flow rate oil}.Cpo.\Delta to \quad (C),$$

wherein:

Kf=the heat exchanging coefficient (is influenced by cooling air flow rate);

A=the heat-exchanging area;

$\Delta t_{1n}$=the logarithmical temperature difference over the heat exchanger for both media;

Cpo=the heat capacity of the oil;

Δto=the temperature difference [T(oil in)−T(oil out)].

With the variation of the number of revolutions of the fan, the heat exchanging coefficient Kf also varies into the same direction and, thus, according to the cooling equation (C) together with the exchanged power and said temperature difference [T(oil in)−T(oil out)].

By combining the above equations (A,B,C), thus, by varying the number of revolutions of the fan 18, the exiting oil temperature T(oil out) from the oil cooler 17 and, thus, the oil injection temperature Toi and, thus, the outlet temperature Tu of the compressor element 1 and the temperature Tx, being equal to it, in the oil separator 8 can be regulated.

From the curves 23, it becomes obvious that for the same environmental conditions the necessary minimum temperature or saturation temperature Tv in the oil separator 8 is the higher, the higher the pressure Pk therein or the working pressure is.

From the equation (C) further follows that for a certain number of revolutions of the fan and, thus, a certain exchanged power, the Δto will be smaller, the larger the mass flow rate of the oil is.

Thus, for higher working pressures, parallel to a higher mass flow rate of the oil through the compressor, for one and the same number of revolutions of the fan the cooling of the oil will be lower than for lower working pressures.

Therefore, for a certain number of revolutions of the fan, the oil will automatically exit the oil cooler 17 at a higher temperature when the working pressure Pk is higher, and at a lower temperature when the working pressure Pk is lower.

Due to this self-regulating feature, in practice a single simple adjustment curve for the number of revolutions of the fan 18 in function of the number of revolutions of the compressor element 1 and, thus, of the number of revolutions of the motor 2 may suffice, independent from the working pressure Pk.

Figure 3:
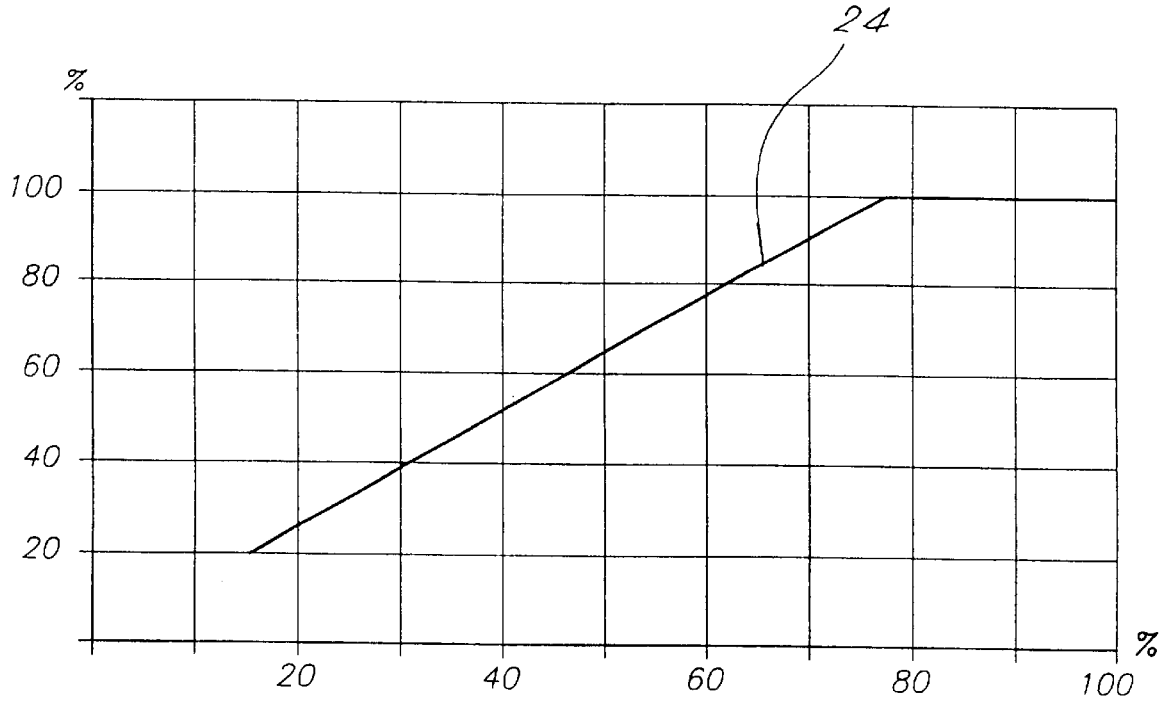
FIG. 3 represents a graphic chart of the speed of the motor of the fan in function of the speed of the motor of the compressor element.

Such curve 24 is represented in FIG. 3, with on the vertical axis the speed Vv of the motor 19 of the fan 18 in percent of its maximum speed and on the horizontal axis the speed Ve of the motor 2, also in percent of its maximum.

This fixed adjustment curve 24 is programmed, either in the control system 22 controlling the frequency transformer 20 in function of the load, or directly in the frequency transformer 20.

Due to this programmed curve 24, the control system 22, he frequency transformer 20 with relatively large capacity, respectively, gives a signal depending on the frequency of this frequency transformer 20 and, thus, in function of the speed Ve of the motor 2, to the frequency transformer 21 with smaller capacity which controls the motor 19 of the fan 18.

As is obvious in FIG. 3, the motor 19 of the fan 18 is revolving at its maximum speed between 100% and approximately 80% of the maximum speed of the motor 2.

The temperature increase over the compressor element 1 is sufficiently high, such that there is no danger of condensation formation.

If the speed of the motor 2 drops further and, thus, also the temperature increase over the compressor element 1 is reduced, also the speed of the motor 19 of the fan 18 diminishes in order to avoid condensation.

In practice, thus, within the application range of the compressor unit with a minimum number of revolutions of the motor 2, being approximately ⅙ of the maximum number of revolutions of this motor 2, a linear curve for the relation between the speeds of the motors 2 and 19 may suffice.

The regulation of the speed of the motor 19 of the fan 18 in function of the speed of the motor 2 of the compressor element 1, described in the aforegoing, does not only avoid the formation of condensate in the oil, but offers important energy economizations as the taken-up capacity of the fan 18 at a minimum number of revolutions only equals approximately 3% of its capacity at a nominal number of revolutions.

Moreover, a lower number of revolutions of the fan 18 offers a lower noise level, such that the average noise level is lowered by adjustment.

Major thermic shocks in the radiator 16 are avoided, and the entire thermic balance of the compressor unit is improved.

Figure 4:
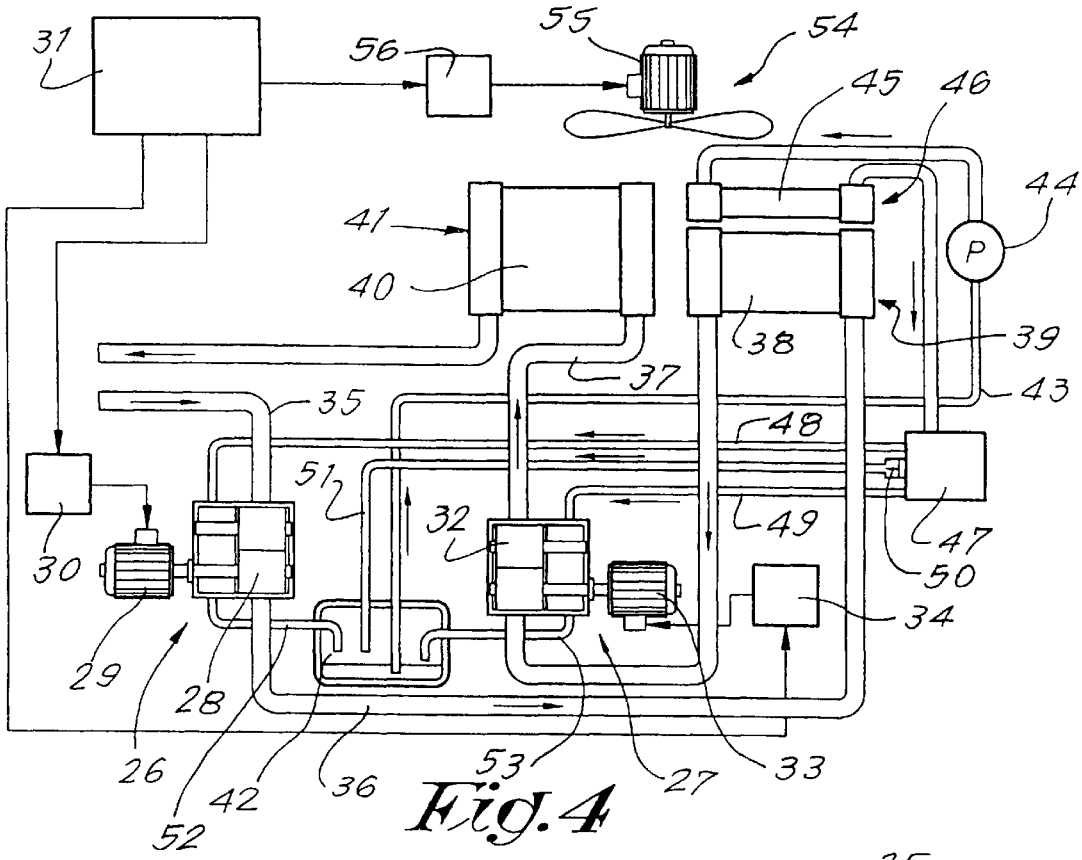
FIG. 4 schematically represents a compressor unit analogous to that of FIG. 1, however, in relation to another form of embodiment.

In the form of embodiment represented in FIG. 4, the compressor unit is an air-cooled oil-free two-stage compressor unit.

As a result thereof, it comprises a low-pressure compressor element 26 and a high-pressure compressor element 27 which are gear compressor elements.

The gear rotors 28 of the low-pressure compressor element 26 are driven by an electric motor 29, the speed of which is controlled by means of a frequency transformer 30 by a control system 31.

The gear rotors 32 of the high-pressure compressor element 27 are driven by a second electric motor 33, the speed of which is controlled by means of a frequency transformer 34 by said control system 31.

The control system 31 controls the two motors 29 and 33 in a manner coupled to each other. Usually, it is such that the high-pressure stage and, thus, the compressor element 27, provide for the desired pressure, this is the working pressure, whereas then the low-pressure stage, this is the compressor element 26, provides for the required air flow rate.

The speeds of both compressor elements 26 and 27 usually alter in the same sense and in a known ratio.

To the compressor element 26, on one hand, connects the suction conduit 35 and, on the other hand, the intermediate conduit 36 which forms the suction conduit for the second compressor element 27. To this latter element then the actual pressure conduit 37 is connected.

The radiator 38 of the intermediate cooler 39 is mounted in the intermediate conduit 36, whereas the radiator 40 of the aftercooler 41 is mounted in the pressure conduit 37.

Although no oil is injected on the gear rotors 28 or 32, the bearings and gear wheels must be lubricated, resulting in that the compressor unit comprises an oil circuit with an oil reservoir 42, an oil conduit 43 connected thereto in which successively a pump 44, the radiator 45 of an oil cooler 46 and a filter 47 are arranged.

From the filter 47, two conduits 48 and 49 extend towards the two compressor elements 26 and 27, respectively, whereas a third conduit 51, operated by a return valve 50, for a possible excess of oil extends towards the oil reservoir 42.

From each compressor element 26 and 27, a conduit 52, 53, respectively, returns to the oil reservoir 42.

The intermediate cooler 39, the aftercooler 41 and the oil cooler 46 have the same fan 54 with an electronically adjustable electric motor 55, and the radiators 38, 40 and 45 thus are mounted adjacent to each other, opposite to the fan 54.

The speed of the motor 55 can be regulated by means of a frequency transformer 56 which also is controlled by control system 31.

In such compressor unit, it is important to avoid a condensation of moisture from the suctioned air occurring in the intermediate cooler 39.

Droplets formed in this intermediate cooler 39 may influence the working of the high-pressure compressor element 27 in a disadvantageous manner.

After the intermediate cooler 39, a liquid separator can be placed, however, this is expensive and time-consuming.

In order to avoid the formation of water droplets, the temperature in the intermediate cooler 39 always must remain above condensation temperature.

The lowest temperature in this intermediate cooler 39, this is, thus, the temperature at the outlet thereof, is depending on the cooling effect of the fan 54 and, in a manner analogous to the manner described heretofore for the temperature in the oil separator 8, can be regulated by varying the speed of the fan 54.

The only difference is that the temperature in the oil separator 8 was influenced upon by the temperature of the injected oil, whereas in this oil-free application, the radiator 38 of the intermediate cooler 39 is an air/air heat exchanger and the air temperature in the radiator 38 is influenced directly by the speed of the fan 54.

By means of tests, empirically the lowest-possible temperature of the intermediate cooler 39 is calculated, whereby there still is no condensation in the most unfavourable circumstances, and with equations, analogous to those used with the form of embodiment according to FIG. 1, a programmable curve 25 can be obtained which shows the ratio of the number of revolutions or the speed of the motor 55 of the fan 54 in function of the number of revolutions or the speed of one of the motors 29 and 33, for example, of the motor 33 driving the high-pressure compressor element 27.

Figure 5:
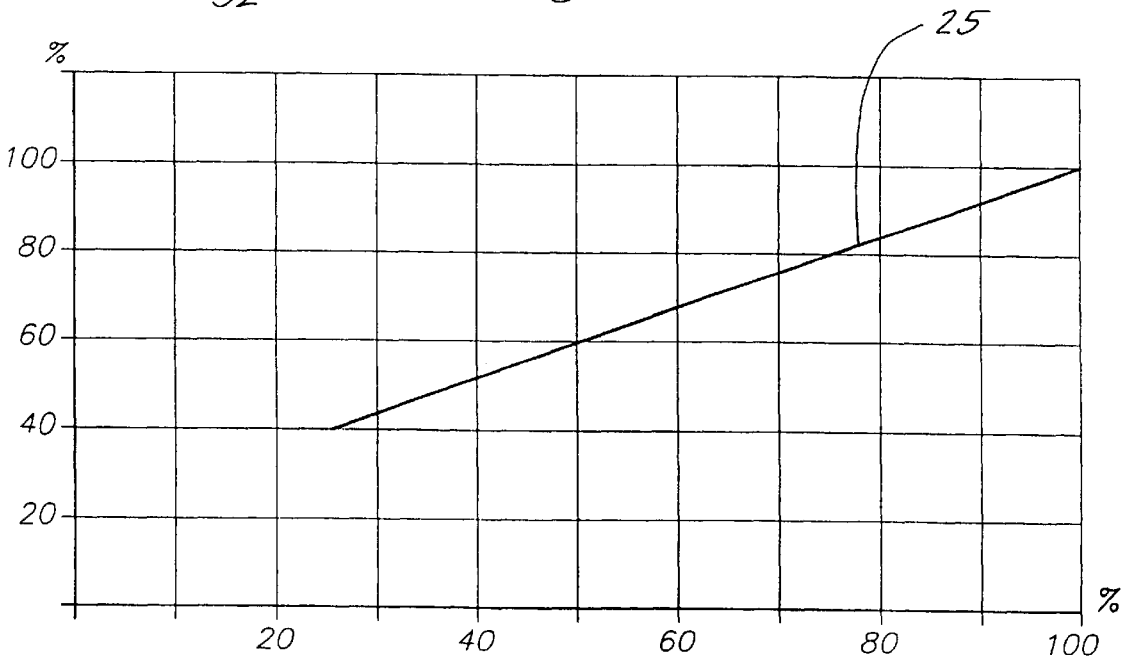
FIG. 5 represents a graphic chart analogous to that of FIG. 3, however, for the compressor unit of FIG. 4.

This curve 25 seems to be practically linear and is represented in FIG. 5.

Thus, there is a coupling between the frequency transformers 34 and 56, either directly or by means of the control system 31 which regulates the speed of the motor 29 or 33 by means of the frequency transformer 34.

In a variant of the preceding form of embodiment, both compressor elements 26 and 27 can be driven by means of transmissions by a single motor.

Figure 6:
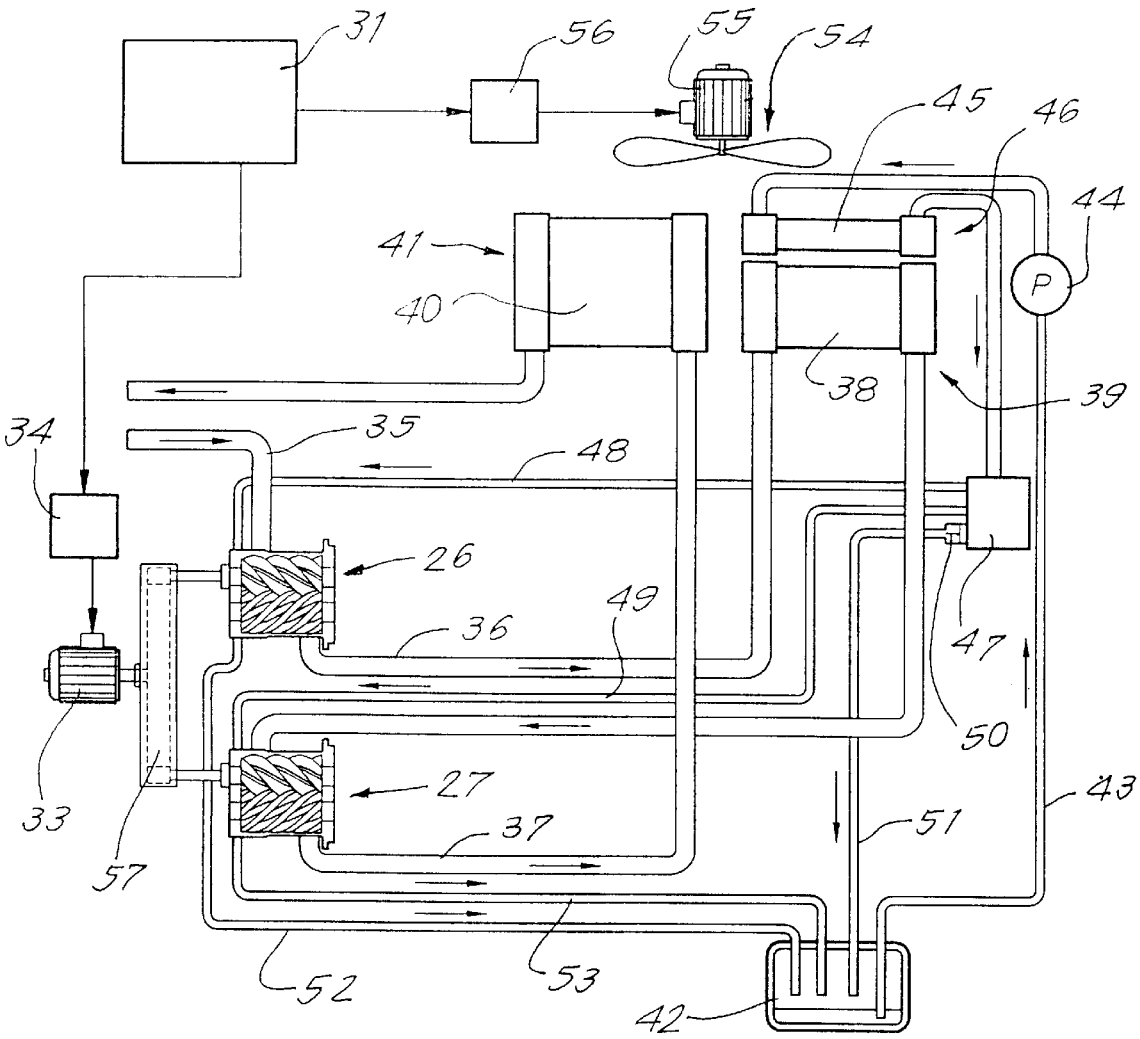
FIG. 6 schematically represents a compressor unit analogous to that of FIGS. 1 and 4, however, in relation to still another form of embodiment.

Such variant is represented in FIG. 6, in which the two oil-free compressor elements 26 and 27 moreover do not comprise gear rotors 28 and 32, but screw rotors.

In this case, for example, only the motor 33 is present which, by means of a gearwheel transmission 57, drives the two compressor elements 26 and 27. In the same manner as described in the aforegoing, the speed of the motor 55 of the fan 55 is regulated in function of the speed of the motor 33.

If radiators 16 or 38 are very large, oil cooler 17, intermediate cooler 39, respectively, may comprise several fans 18 or 54, the motors 19 or 55 of which are controlled together and in the same manner as described in the aforegoing.

Also if several radiators are present, such as in the examples described in the aforegoing, several fans 18 or 54 can cooperate therewith, whereby then the motors of these fans 18 or 54 can be controlled together as well as separate.

At least the fan 18 or 54 mounted opposite to the radiator 16 or 38 of the oil cooler 17, the intermediate cooler 29, respectively, are regulated in the manner described in the aforegoing.

Although the invention in the first place can be applied for compressor units for compressing air, it can also be applied for gases other than air which can comprise moisture which can condensate.

The invention is in no way limited to the forms of embodiment described heretofore and represented in the figures, on the contrary may such compressor unit be realized in different variants, while still remaining within the scope of the invention.

What is claimed is:

1. A method for regulating a fan in a compressor unit including a cooling circuit, at least one compressor element connected to the cooling circuit, at least one compressor element motor with electronically adjustable speed settings arranged to drive the compressor element, and at least one cooler connected to the cooling circuit and having at least one radiator and at least one fan cooperating, with the radiator driven by a fan motor, the method comprising the steps of:

driving the compressor element motor at a speed varying as a function to a load; and regulating the number of revolutions of the motor of the fan as a function of a predetermined level of cooling in the cooling circuit, thereby mitigating condensation of moisture due to excessive cooling.

2. The method of claim 1, wherein the speed of the fan motor is regulated as a function of the speed of the compressor element motor.

3. The method of claim 2, wherein the speed of the fan motor is regulated as a function of the speed of the compressor element motor, such that the ratio of the speeds of both the fan and compressor element motors follows a course according to a predetermined curve.

4. The method of claim 3, wherein the speed of the fan motor is regulated as a function of the speed of the compressor element motor, such that the ratio of the speeds of both the fan and compressor element motors follows a course according to a curve which, with increasing speed up to approximately 80% of the maximum speed of the compressor element motor, generally represents a linear speed ratio.

5. A compressor unit comprising;

at least one compressor element;

at least one compressor element motor arranged to drive the compressor element and controlled with a speed regulation device arranged to regulate the compressor element motor at a speed varying as a function of load on the compressor element; and at least one cooler including at least one radiator and at least one fan cooperating with the radiator and driven by a fan motor, controlled with a speed regulation device arranged to regulate the fan motor as a function of a predetermined level of cooling, thereby mitigating condensation of moisture due to excessive cooling.

6. The compressor unit of claim 5, wherein the speed regulation device of the fan motor is coupled to the speed regulation device of the compressor element motor.

7. The compressor unit of claim 6, wherein the speed regulation device of the compressor element motor includes a frequency transformer, and the speed regulation device of the fan motor includes a frequency transformer, the frequency transformers of both the fan and compressor element speed regulation devices are directly coupled to each other or coupled to each other via a control system.

8. The compressor unit of claim 6, wherein the speed regulation device of the fan motor is coupled to the speed regulation device of the compressor element, and arranged so that the ratio of the speeds of both the fan and compressor element motors follow a course according to a predetermined curve.

9. The compressor unit of claim 8, wherein the predetermined curve, at increasing speeds up to approximately 80% of the maximum speed of the compressor element motor, represents a linear ratio.

10. The compressor unit of claim 5, further comprising:

a pressure conduit carrying oil and connected to the compressor element;

an oil separator connected to the pressure conduit; and a return conduit to the oil separator and the compressor element, the cooler being mounted in the return conduit.

11. The compressor unit of claim 10, wherein the speed regulation device of the fan motor is coupled to the speed regulation device of the compressor element, and arranged so that the ratio of the speeds of both the fan and compressor element motors follows a course according to an empirically predetermined curve; and wherein the predetermined curve, at increasing speeds up to approximately 80% of the maximum speed of the compressor element motor, represents a linear ratio.

12. The compressor unit of claim 5, wherein the at least one compressor element comprises at least one low pressure compressor element and a high pressure compressor element each connected to a compressor element motor controlled by a speed regulation device, an intermediate conduit connecting the high and low pressure compressor elements, and the cooler being mounted therein.

13. The compressor unit of claim 12, wherein the speed regulation device of the fan motor is coupled to the speed regulation device of at least one of the low and high pressure compressor elements.

14. The compressor unit of claim 13, wherein the speed regulation device of the fan motor is coupled to the speed regulation device of the high pressure compressor element, the speed of the fan motor being regulated as a function of the speed of the high pressure compressor element motor, such that the ratio of the speeds of both the fan and compressor element motors follow a course according to a predetermined, generally linear curve.

* * * * *